US007213438B2

(12) United States Patent
Klinkhammer

(10) Patent No.: US 7,213,438 B2
(45) Date of Patent: May 8, 2007

(54) BENDING TOOL WITH ADJUSTABLE WORKPIECE ABUTMENT SEGMENTS

(75) Inventor: Marc Klinkhammer, Ditzingen (DE)

(73) Assignee: Trumpf Werkzeugmachinen GmbH+ Co. KG, Ditzingen (DE)

( * ) Notice: Subject to any disclaimer, the term of this patent is extended or adjusted under 35 U.S.C. 154(b) by 387 days.

(21) Appl. No.: 10/886,398

(22) Filed: Jul. 7, 2004

(65) Prior Publication Data

US 2005/0022577 A1 Feb. 3, 2005

(30) Foreign Application Priority Data

Jul. 7, 2003 (DE) ..... 203 10 428 U

(51) Int. Cl.
*B21J 13/02* (2006.01)
*B21D 9/05* (2006.01)

(52) U.S. Cl. ..... 72/478; 72/389.4

(58) Field of Classification Search ..... 72/478, 72/319–320, 389.4, 413, 473
See application file for complete search history.

(56) References Cited

U.S. PATENT DOCUMENTS 4,653,307 A * 3/1987 Zbornik ..... 72/389.4
4,930,332 A 6/1990 Hongo
5,927,134 A * 7/1999 Kutschker ..... 72/319
5,941,116 A 8/1999 Kunze
6,578,403 B2 * 6/2003 Gascoin ..... 72/389.4

FOREIGN PATENT DOCUMENTS

EP 0 577 068 A1 1/1994

* cited by examiner

*Primary Examiner*—Derris H. Banks
*Assistant Examiner*—Teresa M. Bonk

(57) ABSTRACT

A bending tool (3) for bending workpieces (4) has at least one part with which an upward bend can be made in the workpiece (4) by an abutment of part of the bending tool acting on it along a line of force of the tool. At least one part of the bending tool has workpiece abutment segments (6, 7) which can be adjusted to different functional positions in relation to one another in the direction of the line of force and overlap one another with mutual separation along the line of force in the direction of the line of force. Adjacent segments are coupled and guided in their movement towards and away from each other. The bending tool may have an actuator to effect the relative movement of the segment and the actuator may be operated by the numeric control for the bending machine.

15 Claims, 8 Drawing Sheets

BENDING TOOL WITH ADJUSTABLE WORKPIECE ABUTMENT SEGMENTS

BACKGROUND OF THE INVENTION

The invention concerns a bending tool for bending workpieces, especially sheet metal, with at least one part by means of which the workpiece can be bent when acted on by an abutment of part of the bending tool along the line of force of the tool, and at least one part of the bending tool has workpiece abutment segments that can be adjusted to different positions in relation to one another in the direction of the line of force.

In industrial practice, it is often necessary to change the width of bending tools or individual parts of them. If a workpiece needs to be bent with a conventional bending tool with upper and lower dies and was first free-cut on a piece of sheet metal connected to the rest of the sheet on one side, to prevent the rest of the sheet from being deformed, the width of the upper die and the width of the lower die may exceed the bending length of the workpiece, in any case, by the width of the cutting gap between the workpiece and the rest of the sheet. Different bending lengths thus require different widths for the upper and lower dies. It is also possible to imagine cases of machining where only the width of one of the two parts of the bending tool needs to be changed.

Segmented upper and lower dies whose individual segments come in different widths are needed to provide variable tool widths. The tool widths can be adjusted to meet the requirements of the machining job by putting the segments together. The segments of both the upper and lower die are lined up next to one another with no gaps in between. If the tool width that is needed changes, tool segments can be removed and not replaced, added or replaced with segments of another width.

A generic bending tool is known from EP 0 577 068 A1. In the state of the art, a part of the bending tool in the form of a hold-down clamp that works with a swiveling cheek is divided into segments which are arranged next to one another in the direction of the line of force used to machine the workpiece. The distances between the adjacent clamp segments can be varied by means of an adjustment device. That way, the entire width of the clamp can be varied. To make the clamp the minimum width, the clamp segments are placed close together in a tight sequence. To enlarge the clamp segments, spaces are made in the line that the tool follows.

The purpose of this invention is to provide a high quality bending tool, which is variable in width of the tool or part of it, and to incorporate this type of bending tool into a bending machine.

A specific object is to provide such a tool in which the adjacent segments are coupled and guided in their relative movement by interfitting elements.

SUMMARY OF THE INVENTION

It has now been found that the foregoing and related objects may be readily attained in a bending tool assembly for bending workpieces having at least one bending tool to produce a bend in a workpiece by acting on it with a workpiece abutment part of the bending tool along a line of force on the tool side, and at least one part of the bending tool has multiple workpiece abutment segments which can be set in relation to one another to different functional positions, characterized by the fact that in the direction of the line of force the workpiece abutment segments are coupled and adjustable in relation to one another to different functional positions and overlap with mutual separation along the line of force in the direction of the line of force.

Preferably, the workpiece abutment segments can be adjusted in relation to one another continuously in the direction of the line of force and are coupled and guided in the direction of the line of force so they can move in relation to one another in the direction of the adjustment movement.

Desirably, the adjacent segments have overlapping portions with interfitting guide elements to provide the coupling and guidance.

One part of the bending tool assembly is in the form of a clamp and another part of the bending tool assembly is in the form of a cheek, whereby the workpiece can be acted on by the clamp and by the bending cheek along a line of force. One of the clamp and the cheek has a workpiece abutment with segments that can be adjusted to different functional positions in relation to one another in the direction of the line of force. The workpiece abutment segments with mutual separation overlap along the line of force in the direction of the line of force. The clamp is comprised of multiple segments which can be adjusted in the direction of the line of force to different functional positions in relation to one another and at least one workpiece abutment segment lies on the outside in the direction of the line of force and is designed as a corner segment with a lateral projection projecting in the direction of the line of force. In a bending machine including the bending tool assembly of the present invention, the workpiece abutment segments are coupled and adjustable in relation to one another to different functional positions and overlap with mutual separation along the line of force in the direction of the line of force. The bending tool includes an actuator for movement of the segments, and the workpiece abutment segments can be adjusted in relation to one another by the actuator in the direction of the line of force by means of a control mechanism which is numerically controlled and the numerical control for the actuator is included into the numerical control of the bending machine in which the tool is installed.

The present invention makes it possible to vary the width of the bending tool or the parts of the tool in question by changing the positions that adjacent workpiece-abutment segments take in relation to one another along the tool's line of force. To enlarge the width, the segments in question are pushed apart, starting from a tightly packed sequence, for example. In many cases, it is possible to omit changing, removing or adding segments to match the width of the bending tool or part of it to changing machining jobs. Mutual overlapping of segments in the direction of the line of force and mutual separation of these types of segments along said line prevent gaps between the segments arranged relative to one another on the line of force when an adjustment is made to change the width of the bending tool or the part of it in question. The part of the line of force assigned to the adjacent segment is connected to the part of the line of force formed from a segment. High quality forming can be achieved, regardless of the division of the workpiece abutment into segments that are adjustable in relation to one another.

The inventive concept of bending tools with a different design has advantages. Individual examples of several tool designs in question are downwardly movable bending tools, swiveling bending tools and rotary bending tools. On upper dies in conventional lowering bending tools, the line of force runs in or near the die forming edge. On the lower dies of these types of bending tools, the lines of force extend roughly on their sides or longitudinal edges, depending on the shape of the cross section of the die groove. It is possible to integrate the adjustment of the segments, and hence the width adjustment of the bending tool or the part of the tool in question, in automated sequences on a bending machine. This ensures a definite adjustment motion and hence precise, custom positioning of the workpiece abutment segments. Because of the mutual guidance of the workpiece abutment segments being adjusted in relation to one another, their overall arrangement can be inherently stable regardless of their relative motion.

A special advantage is attained if the clamp has several segments that can be adjusted to different functional positions in relation to one another in the direction of the line of force and that overlap one another with mutual separation along the line of force in the direction of the line of force. At least one of the segments is designed as a corner segment in the direction of the segment lying outside the line of force, and it, in turn, has a lateral projection projecting in the direction of the line of force.

These types of bending tools are also used to produce bent parts with complex shapes. Corner segments of the clamp extend in front along the line of the bend being produced, and their lateral projection fits, for example, inside the upwardly extending flanges already made, which in turn project with one leg of the workpiece in the direction of the line of the bend projecting toward the clamp. Before the workpiece is actually formed, the clamp is first moved past the flange just made toward the workpiece and after that is introduced into the flange with the corner segment. Because of the invention design, the clamp can first be given a relatively small width by moving the abutment segments close together and in this state set on the workpiece or put into a position near the workpiece. Then, the width of the clamp is enlarged by adjusting the adjacent abutment segments to a width in which the corner segment reaches its rear grip setting. In the state that then occurs, the clamp can act on the workpiece over the entire length of the bend being made, thereby effectively forming a seamless line of force.

BRIEF DESCRIPTION OF THE ATTACHED DRAWINGS

The invention will be explained in greater detail below using schematic drawings of exemplary embodiments.

DETAILED DESCRIPTION OF THE PREFERRED EMBODIMENT

Figure 1:
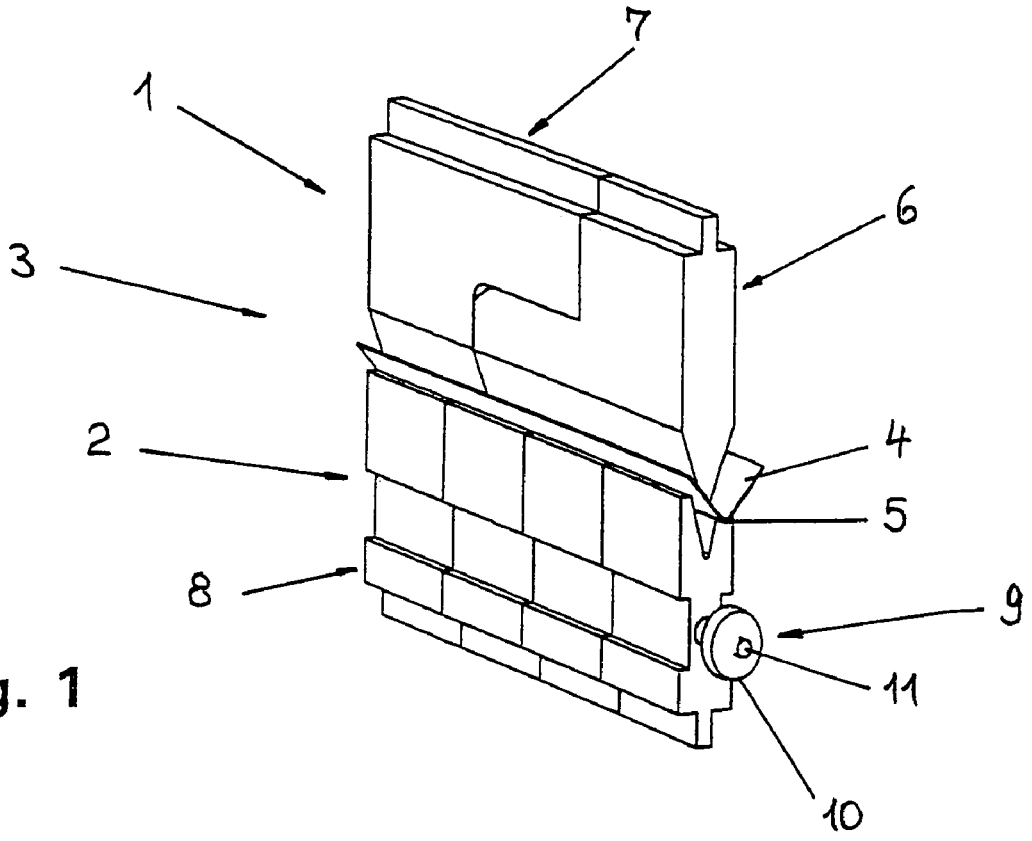
FIG. 1 is a perspective view of an upper die with segments adjustable in relation to one another in the initial operating mode and a lower die with segments that can be adjusted relative to one another.

According to FIG. 1, an upper die generally designated by the numeral 1 and a lower die generally designated by the numeral 2 form a bending tool generally designated by the numeral 3, which is used as a downwardly movable bending tool for forming a sheet of metal 4 along the bending line 5. The upper die 1 is comprised of two workpiece abutment segments in the form of die segments 6, 7. The lower die 2 includes, as workpiece abutment segments, a total of four segments 8. The upper die segments 6, 7 and the lower die segments 8*a* can be adjusted in relation to one another to different functional positions in the direction of bending line 5. A manual control mechanism generally designated by the numeral 9 for the lower die segments 8 includes a thumb screw 10, which serves as the set screw and is mounted on a threaded bolt 11. The threaded bolt 11 goes through the lower die segments 8.

Figure 2:
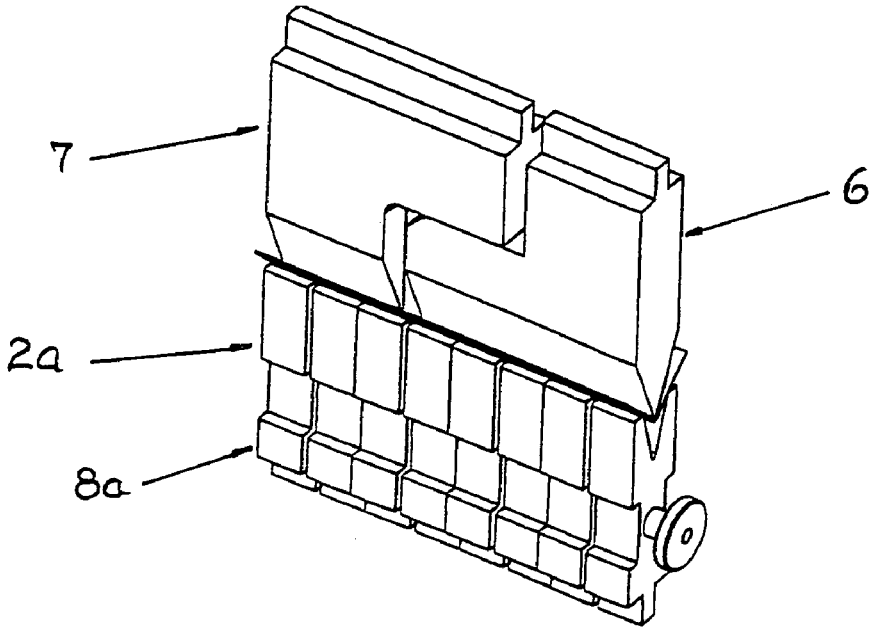
FIG. 2 is a perspective view of the upper die in FIG. 1 in a second operating position, as well as a second lower die with segments that can be adjusted in relation to one another.

On the axial end, not visible in FIG. 1, the threaded bolt 11 is supported in the axial direction on the outer left segment 8 of the lower die 2 in FIG. 1. Between the lower die segments 8*a*, the threaded bolt 11 has coil springs (not shown) on them that are pre-tensioned. If the thumb screw 10 is turned counterclockwise starting from the position in FIG. 1, the pre-tensioned coil springs push the lower die segments 8 apart. This increases the width of the lower die 2 formed by the segments 8. In this expanded state, a lower die 2*a* is shown in FIG. 2 that is comprised of workpiece abutment segments in the form of lower die segments 8*a*. As an alternative to the manual control mechanism 9 shown, mechanical control mechanisms may be employed, which can also be operated by a numerical control under certain circumstances.

The width of the upper die 1 can be varied accordingly. The control mechanism provided for this purpose is not shown in FIGS. 1 and 2, for the sake of simplicity. In FIG. 1, the die segments 6, 7 are close together in the direction of bending line 5. In this operating position, the upper die 1 is at its minimum width. In FIG. 2, the die segments 6, 7 are pushed apart in the direction of bending line 5. The width of the upper die 1 has consequently increased compared to the condition in FIG. 1.

Figure 3:
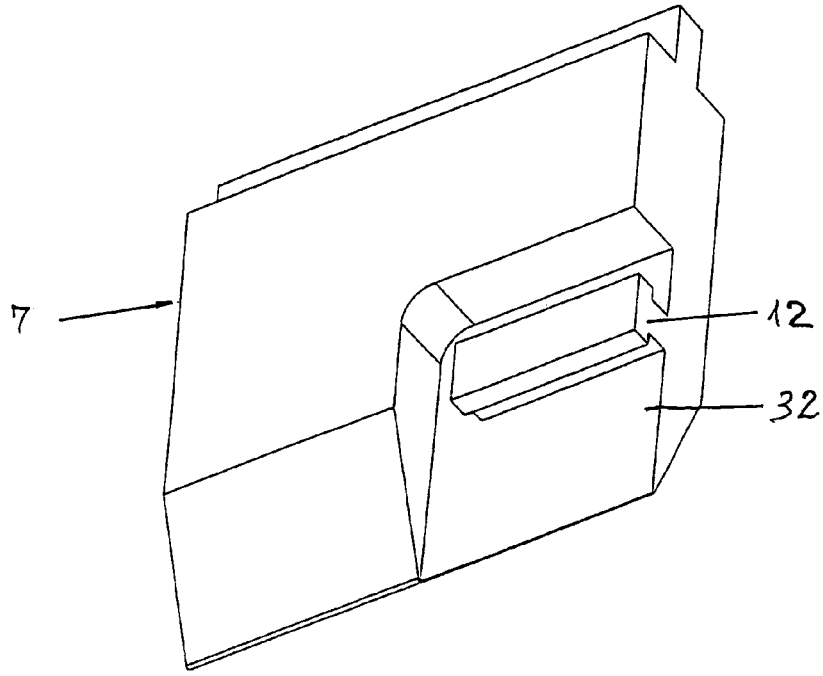
FIGS. 3 and 4 are perspective views of the segments of the upper die in FIGS. 1 and 2.
Figure 4:
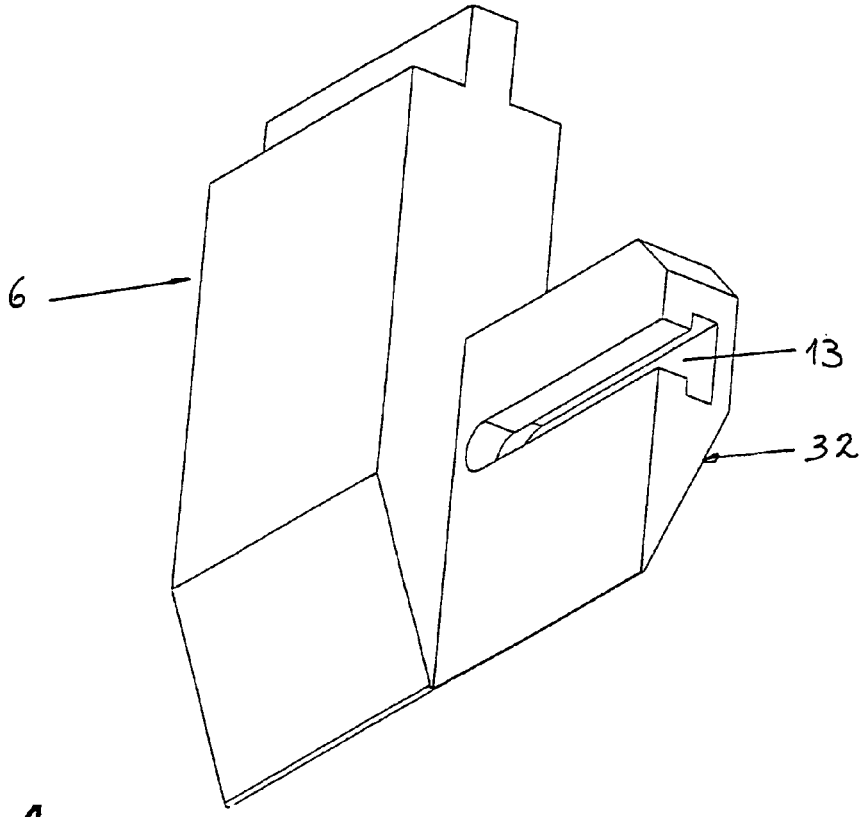

In FIGS. 3 and 4, the die segments 6, 7 are moved in relation to one another so they can extend in the direction of their adjustment movement. Overlying and interfitting machined portions provide a guide generally designated by the numeral 32 and include a boss or projecting key 12 that is T-shaped in cross section on the die segment 7 and a complementary shaped, undercut guide groove or keyway 13 on the die segment 6. Due to the type of guide selected, die segments 6, 7 form an inherently stable unit regardless of their relative position.

Figure 5:
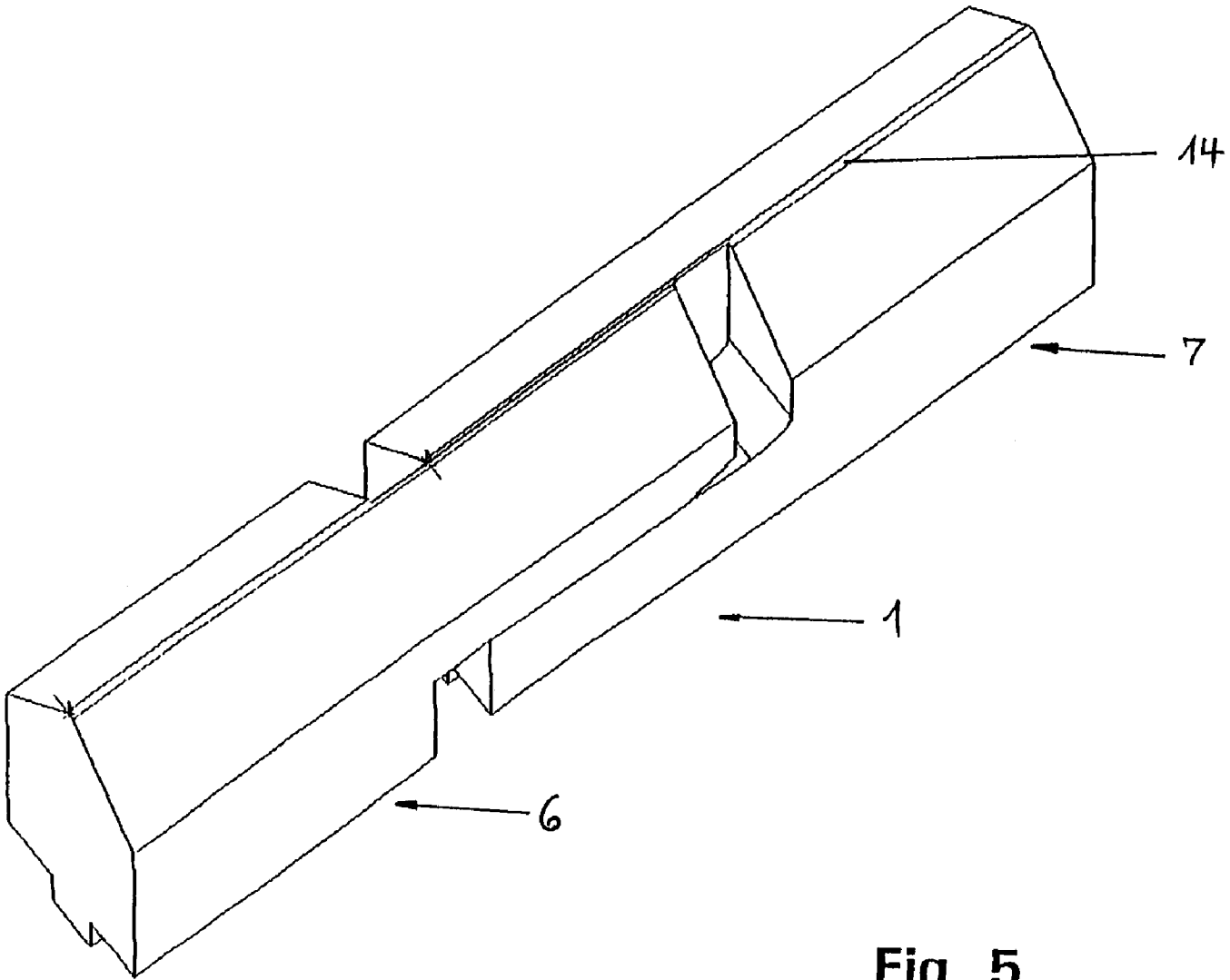
FIG. 5 is a top perspective view of the upper die of FIG. 2 showing the forming edge and the segments moved into an expanded length.

As can be seen from FIG. 5, the die segments 6, 7 are separated from one another on one forming edge. The forming edge defines in good approximation a line of force 14, i.e., the area upon which the upper die 1 acts when machining the sheet metal 4 to form the bending line 5. When the workpiece is being formed, the line of force 14 and the bending line 5 run parallel to one another. The die segments 6, 7 overlap one another over their entire mutual adjustment area. As a result of the separation of die segments 6, 7 on the forming edge and/or line of force 14 and as a result of the mutual overlapping of die segments 6, 7 when the die segments 6, 7 are pushed apart during the forming of the sheet metal 4 in the direction of the line of force 14 or bending line 5, there are no gaps.

The conditions on lower dies 2, 2*a* are shown accordingly. For lower die 2*a*, this can be seen in FIG. 6. Lines of force 15, 16 run on sides 17, 18 of a lower die groove 19. The lower die segments 8*a* overlap one another in the direction of lines of force 15, 16. The lower die segments 8*a* are separated along lines of force 15, 16, so that when the lower die segments 8*a* are pushed apart, there are no gaps in lines of force 15, 16.

While the sheet metal 4 is being formed, depending on the radius of the tip of the upper die 1 or the gauge of the sheet metal being formed 4, the lines of force 14, 15, 16 can move transversely.

Figure 6:
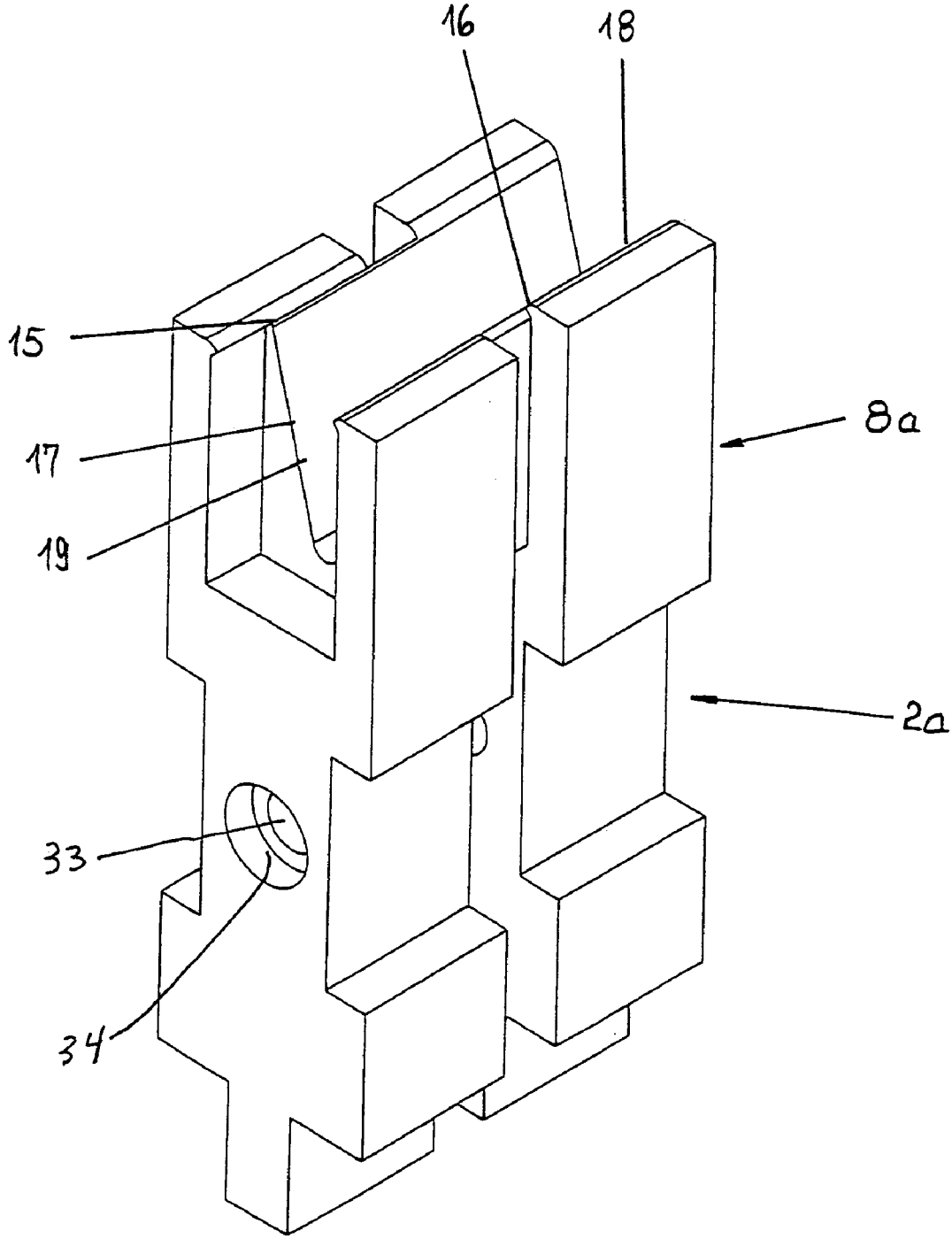
FIG. 6 is a perspective view of two segments of the lower die of FIG. 2.

FIG. 6 shows the passage 33 provided in the lower die segments 8*a* for the threaded bolts 11 of the control mechanism for mutual adjustment of the lower die segments 8*a*. The expanded diameter portions 34 of the passage 33 through which the threaded bolt 11 extends are for the pre-tensioned coil springs (not shown) placed between the lower die segments 8*a*.

Figure 7:
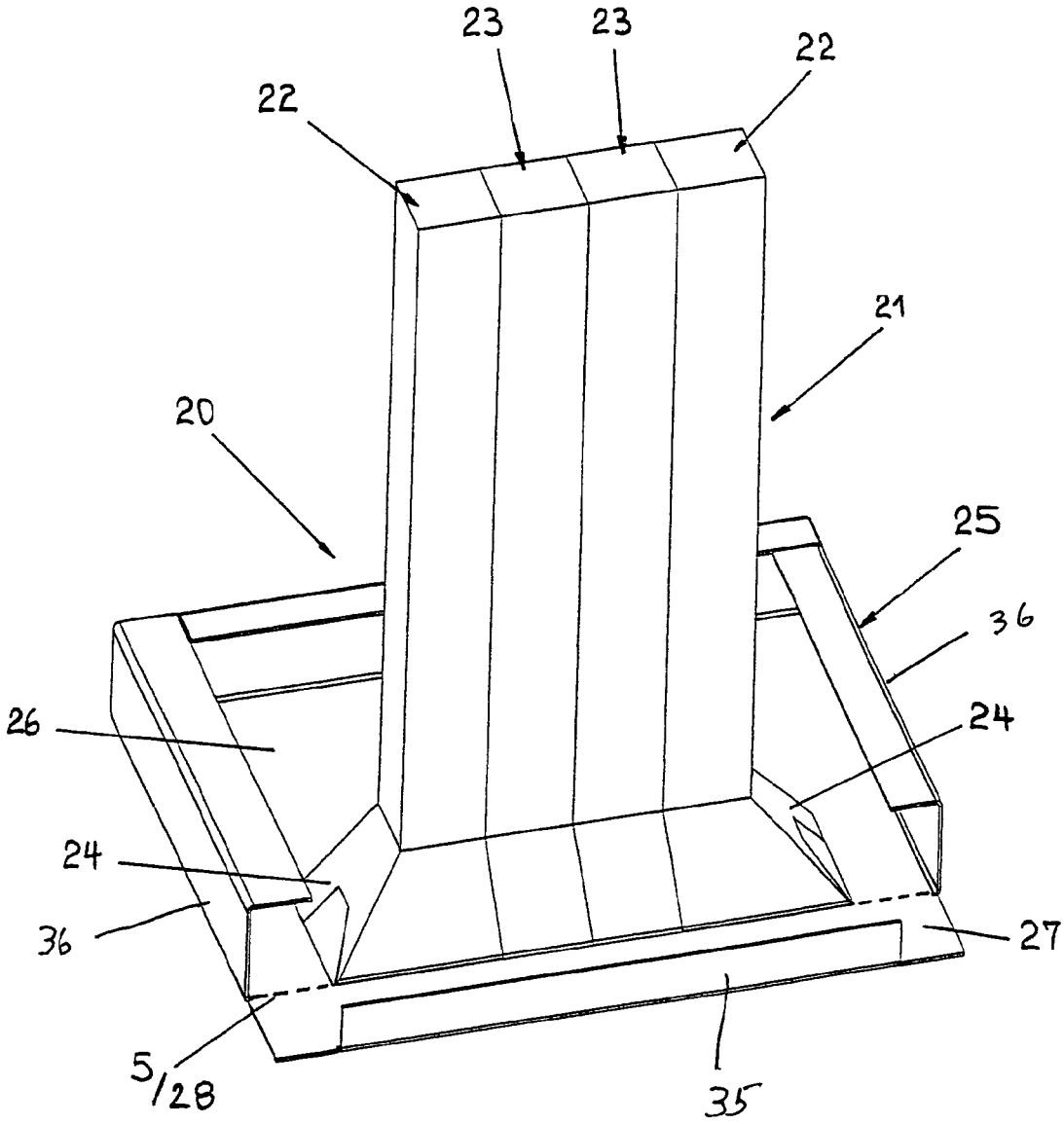
FIG. 7 is a perspective view of the clamp of a swiveling bending tool with segments that can be adjusted in relation to one another, in the initial operating position on a workpiece.
Figure 8:
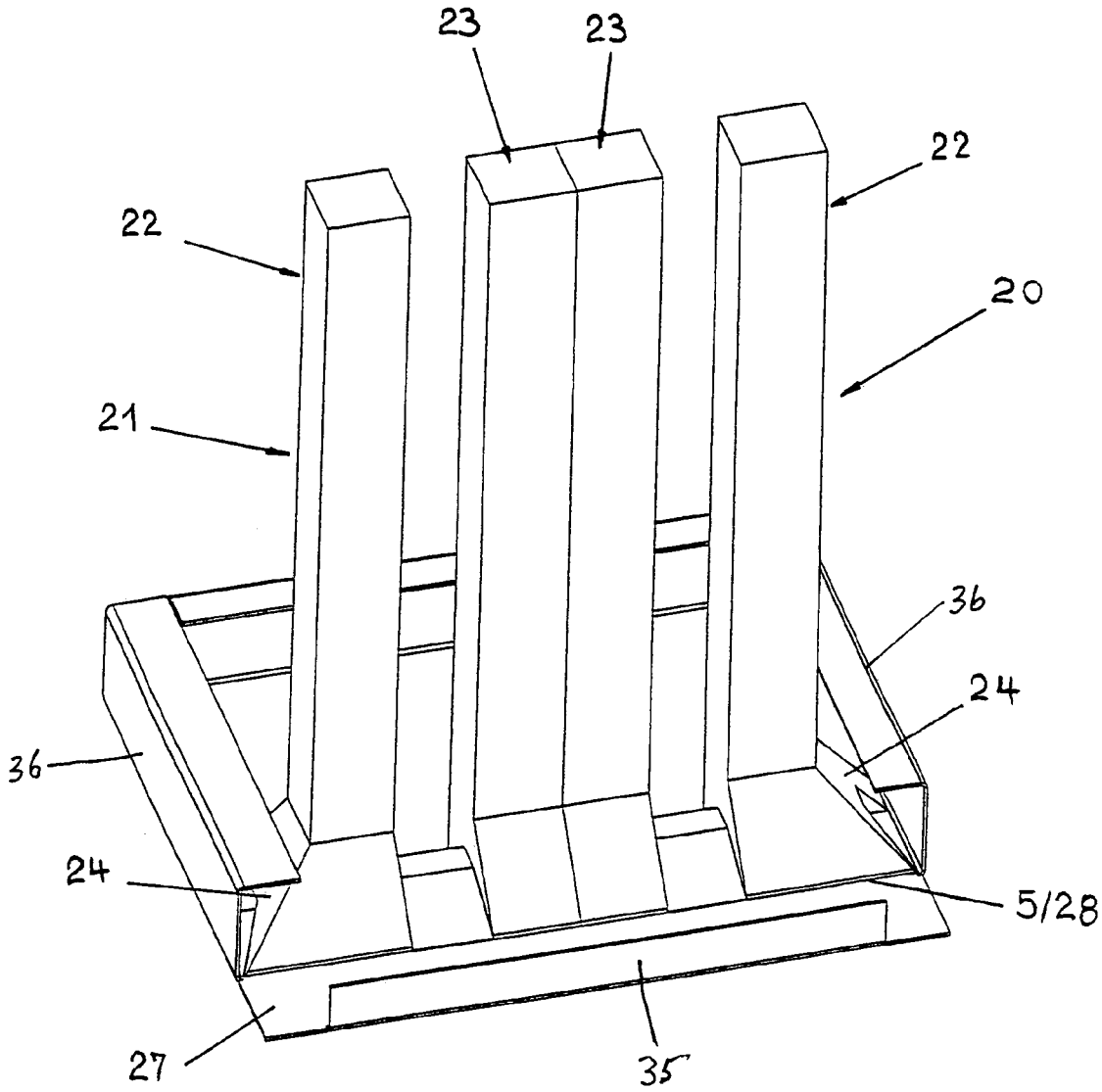
FIG. 8 is a perspective view of the clamp of FIG. 7 in a second operating position.
Figure 9:
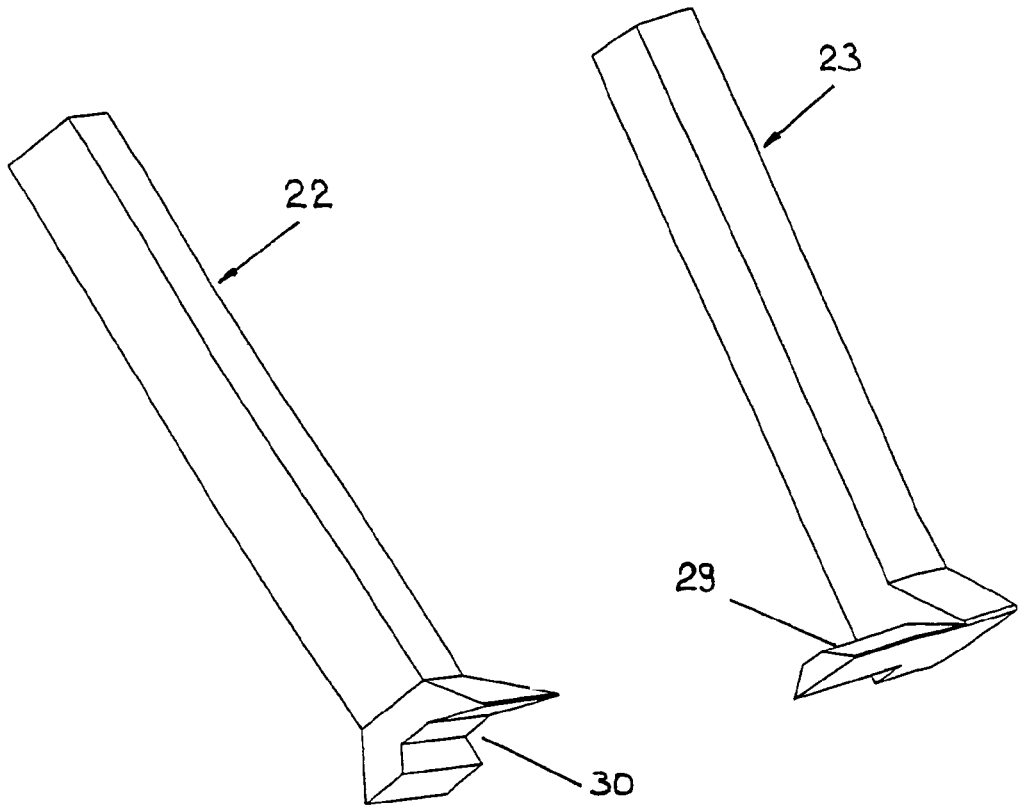
FIG. 9 is a perspective view of two segments of the clamp shown in FIGS. 7 and 8.

FIGS. 7 to 9 show a bending tool designed as a swivel bending tool generally designated by the numeral 20. The swivel bending tool 20 includes, besides a conventional bending cheek, a clamp generally designated by the numeral 21 with workpiece abutment segments in the form of clamp segments 22, 23. The clamp segments 22 are designed as corner segments and as such have laterally projecting portions 24.

The swivel bending tool 20 is used to form a workpiece generally designated by the numeral 25 along the dotted bending line 5 shown in FIG. 7. A workpiece portion 27 is already provided with a perpendicularly extending flange 35. The side flanges 36 extend perpendicularly to the bending line 5 and have a vertical leg or portion extending upwardly as well as a horizontal leg or portion extending toward and parallel to the plane of the body portion 26.

To produce the desired upward bend, the clamp 21 is first in the position seen in FIG. 7 wherein it is seated on the body portion 26 of the workpiece 25. The clamp segments 22, 23 are close together, the clamp 21 is at its minimum width and can consequently, when it moves on the body portion or base 26, move under the horizontal legs or portions of the already existing side flanges 36. In the operating mode shown in FIG. 7, the clamp 21 sits on the base portion 26 of the workpiece 25 with no pressure.

Starting from these conditions, the corner segments 22 of the clamp 21 are moved by a control mechanism (not shown) to the outside away from the clamp segments 23 on the inside. The lateral projections 24 of the corner segments 22 therefore extend into the space between the horizontal legs of the flanges 36 and the base or body portion 26 of the workpiece 25. The conditions produced as a result can be seen in FIG. 8. It is now possible for the base body portion 26 to be acted upon even under the horizontal leg of the flanges 36.

After the clamp segments 22, 23 are pushed apart, the now widened clamp 21 is pushed down onto the body portion 26 of the workpiece 25. The result is flat pressure on the base plate portion 26 by the clamp 21.

By swiveling the bending cheek (not shown) upwardly, the workpiece flange portion 27 is bent upwardly. To form bending line 5, the clamp 21 interacts with the bending cheek again with flat action of the base plate 26 along a line of force 28. A line of force is also produced on the bending cheek.

The inner clamp segments 23 overlap with the directly adjacent corner segment 22 in the direction of the line of force 28 and each inner clamp segment 23 is separated from the accompanying corner segment 22 along the line of force 28. If the corner segments 22 are pushed out compared to the inner clamp segments 23, the base plate 26 of the workpiece 25 is also acted on with no gaps along the line of force 28 or bending line 5.

As can be seen from FIG. 9, the clamp segments 22, 23 are coupled with one another by means of a laterally extending guide portion 29 that is trapezoidal in cross section on the inside segment of the clamp 23 and a guide groove 30 having a corresponding cross sectional shape on the outer corner segment 22. Thus, the clamp segments 22, 23 can be moved toward and away from one another in the direction of the adjustment movement.

After the workpiece plate 27 is bent upwardly, the pressure acting on the body portion 26 is released by the clamp 21. Moving the clamp segments 22, 23 together puts the clamp 21 back in the operating position seen in FIG. 7. The width of the clamp 21 then makes it possible to remove the finished bent part from the swivel bending tool 20.

Figure 10:
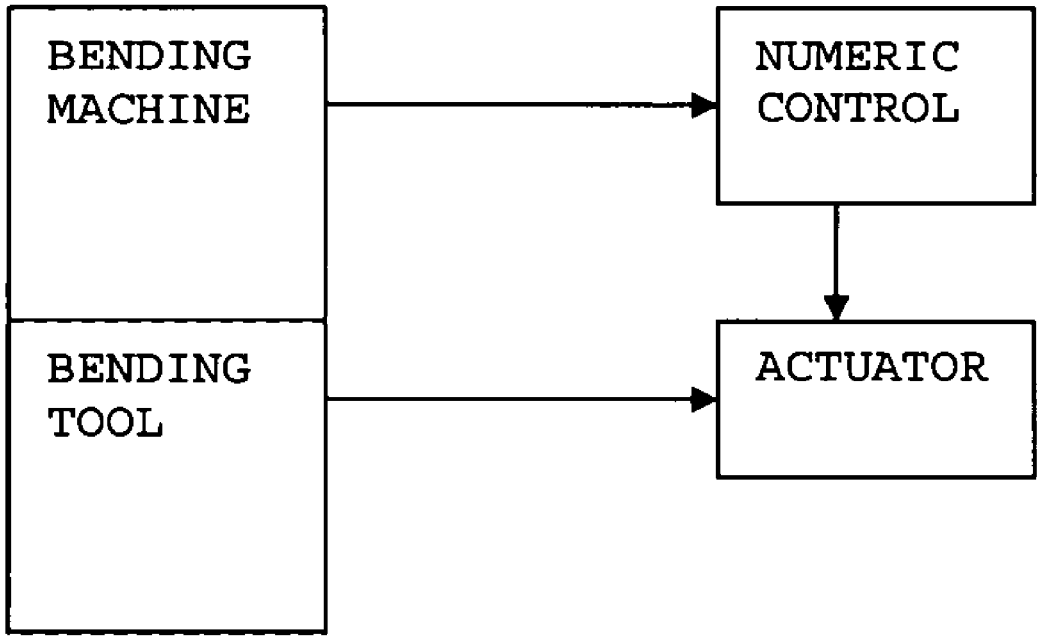
FIG. 10 is a schematic illustration of a bending machine in which the bending tool of the present invention includes an actuator operated under the numeric control for the machine.

As seen in FIG. 10, the bending tool 41 of the present invention is incorporated in a bending machine 40 and the tool 41 includes an actuator 42 to move the segments of the tool 41. The numeric control 43 of the bending machine 40 also operates the actuator 42.

Having thus described the invention, what is claimed is:

1. A bending tool assembly for bending workpieces (4, 25) having at least one bending tool to produce a bend in a workpiece (4, 25) by acting on it with a workpiece abutment part of the bending tool defining a line of force (15, 15, 26, 29) and at least one part of the bending tool being comprised of multiple workpiece abutment segments (6, 7; 8; 8*a*; 22, 23) together providing said line of force and, which can be set in relation to one another to different functional positions along said line of force (14, 15, 16, 28), said workpiece abutment segments (6, 7; 8; 8*a*; 22, 23), being separated along said line of force (14, 15, 16, 28) and having overlapping portions in the direction of said line of force (14, 15, 16, 28).

2. The bending tool assembly in accordance with claim 1, characterized by the fact that the workpiece abutment segments (6, 7; 8; 8*a*; 22, 23) can be adjusted in relation to one another continuously in the direction of said line of force (14, 15, 16, 28).

3. The bending tool assembly in accordance with claim 1 characterized by the fact that workpiece abutment segments (6, 7; 8; 8*a*; 22, 23) that are adjustable in relation to one another are guided in the direction of said line of force (14, 15, 16, 28) so they can move in relation to one another in the direction of the adjustment movement.

4. The bending tool assembly in accordance with claim 1 characterized by the fact that the workpiece abutment segments (6, 7; 8; 8*a*; 22, 23) that are adjustable in relation to one another in the direction of said line of force (14, 15, 16, 28) are coupled and guided in relation to one another, so they can move in relation to one another in the direction of the adjustment movement.

5. The bending tool assembly in accordance with claim 1 wherein the adjacent segments have overlapping portions with interfitting guide elements.

6. The bending tool assembly in accordance with claim 1 wherein one part of the bending tool assembly is in the form of a clamp (21) and another part of the bending tool assembly is in the form of a cheek, whereby the workpiece (25) can be acted on by the clamp (21) and by the bending cheek along said line of force (28) and wherein one of the clamp (21) and the cheek has a workpiece abutment with segments (22, 23) that can be adjusted to different functional positions in relation to one another in the direction of said line of force (28), characterized by the fact that the workpiece abutment segments (22, 23) with mutual separation along said line of force (28) overlap in the direction of said line of force (28).

7. The bending tool in claim 6, wherein the clamp (21) is comprised of multiple segments which can be adjusted in said direction of the line of force (28) to different functional positions in relation to one another, and the workpiece abutment segments (22, 23) overlap each other with mutual separation along the line of force (28) in the direction of said line of force (28), characterized by the fact that at least one workpiece abutment segment (22) lies on the outside in the direction of said line of force (28) and is designed as a corner segment with a lateral projection (24) projecting in said direction of the line of force (28).

8. A bending machine for bending workpieces including a bending tool assembly for bending workpieces (4, 25) having at least one bending tool to produce a bend in a workpiece (4, 25) by acting on it with a workpiece abutment part of the bending tool defining a line of force (15, 15, 26, 29) and at least one part of the bending tool being comprised of multiple workpiece abutment segments (6, 7; 8; 8*a*; 22, 23) together providing said line of force and which can be set in relation to one another to different functional positions along said line of force (14, 15, 16, 28), said workpiece abutment segments (6, 7; 8; 8*a*; 22, 23), being separated along said line of force (14, 15, 16, 28) and having overlapping portions in the direction of said line of force (14, 15, 16, 28).

9. The bending machine in accordance with claim 8 wherein the bending tool includes an actuator for movement of the segments.

10. The bending machine in accordance with claim 9 characterized by the fact that the workpiece abutment segments (6, 7; 8; 8*a*; 22, 23) can be adjusted in relation to one another by the actuator (40) in the direction of said line of force (14, 15, 16, 28) by means of a control mechanism (41).

11. The bending machine in accordance with claim 10 characterized by the fact that the control mechanism (41) is numerically controlled.

12. The bending tool in accordance with claim 11 characterized by the fact that the numerical control of the actuator (40) is included into the numerical control of the bending machine in which the tool is installed.

13. A bending tool assembly for bending workpieces (4, 25) having at least one bending tool to produce a bend in a workpiece (4, 25) by acting on it with a workpiece abutment part of the bending tool defining a line of force (15, 15, 26, 29) and at least one part of the bending tool being comprised of multiple workpiece abutment segments (6, 7; 8; 8*a*; 22, 23) together providing said line of force and which can be set in relation to one another to different functional positions along the line of force (14, 15, 16, 28) said workpiece abutment segments (6, 7; 8; 8*a*; 22, 23) being separated along said line of force (14, 15, 16, 28) and having overlapping portions in the direction of said line of force (14, 15, 16, 28), the workpiece abutment segments (6, 7; 8; 8*a*; 22, 23) being adjustable in relation to one another continuously in the direction of said line of force (14, 15, 16, 28), said workpiece abutment segments being coupled and guided in relation to one another, so they can move in relation to one another in the direction of the adjustment movement.

14. The bending tool assembly in accordance with claim 13 wherein adjacent segments have overlapping portions with interfitting guide elements.

15. The bending tool assembly in accordance with claim 14 wherein one part of the bending tool assembly is in the form of a clamp (21) and another part of the bending tool assembly is in the form of a cheek, whereby the workpiece (25) can be acted on by the clamp (21) and by the bending cheek along said line of force (28) and wherein one of the clamp (21) and the cheek has a workpiece abutment with segments (22, 23) that can be adjusted to different functional positions in relation to one another in the direction of said line of force (28), characterized by the fact that the workpiece abutment segments (22, 23) are separated along said line of force (28) and have portions which overlap in the direction of said line of force (28).

* * * * *